US006378161B1

(12) United States Patent
Parry

(10) Patent No.: US 6,378,161 B1
(45) Date of Patent: Apr. 30, 2002

(54) CLEANING ELEMENT

(75) Inventor: Steve Parry, Clitheroe (GB)

(73) Assignee: BMP Europe Limited (GB)

( * ) Notice: Subject to any disclaimer, the term of this patent is extended or adjusted under 35 U.S.C. 154(b) by 0 days.

(21) Appl. No.: 09/374,566

(22) Filed: Aug. 13, 1999

Related U.S. Application Data

(63) Continuation of application No. PCT/GB98/00451, filed on Feb. 13, 1997.

(30) Foreign Application Priority Data

Feb. 13, 1997 (GB) ..... 9702911
Jun. 27, 1997 (GB) ..... 9713504

(51) Int. Cl.[7] ..... G03G 15/20

(52) U.S. Cl. ..... 15/256.52; 15/208; 15/230; 15/230.12; 15/230.13; 15/256.51; 399/346; 399/357; 399/343; 428/92; 428/397

(58) Field of Search ..... 15/208, 209.1, 15/230, 230.12, 230.13, 256.51, 256.52, 207.2, 179; 399/325–327, 343, 346, 352, 353, 357; 428/92, 397

(56) References Cited

U.S. PATENT DOCUMENTS 3,826,581 A * 7/1974 Henderson ..... 401/197
3,914,488 A * 10/1975 Gorrafa ..... 428/397
4,244,074 A * 1/1981 Barcikowski et al. ..... 15/114
5,606,400 A * 2/1997 Nagayasu et al. ..... 399/343
5,618,624 A * 4/1997 Dinger et al. ..... 428/92 X
5,759,662 A * 6/1998 Heiman ..... 428/85
5,815,876 A * 10/1998 Overseth ..... 15/179

* cited by examiner

*Primary Examiner*—Mark Spisich
(74) *Attorney, Agent, or Firm*—Welsh & Katz, Ltd.; Thomas W. Tolpin

(57) ABSTRACT

A cleaning element (1) for use in the fuser section of electrostatographic reproduction or printing apparatus. The element includes projections projecting from an outer surface to form a pile (5). The cross section of each projection has a cross section having a peripheral dimension and an area. The ratio of the peripheral dimension and area is greater than the same ratio for a projection of circular or substantially circular and equal area of cross section. The projections may be formed by tri-lobal fibres.

16 Claims, 2 Drawing Sheets

CLEANING ELEMENT

RELATED APPLICATION

This Application is a continuation of International Application No. PCT/GB98/00451, filed Feb. 13, 1997.

BACKGROUND OF THE INVENTION

The present invention relates to a cleaning element, particularly although not exclusively for use in electrostatographic reproduction or printing apparatus.

In conventional electrostatographic apparatus, for example a photocopier, toner is deposited onto one side of a sheet of paper, to form an image. The paper is then fed into the fuser section of the machine where it is heated, typically by passage between two rollers, one of which is heated to approximately 180° C. The heated roller makes contact with the side of the sheet of paper onto which toner has been deposited, causing the individual toner particles to fuse together and adhere to the paper.

A problem associated with the use of heated rollers is that some toner particles adhere to the roller, rather than to the paper. Paper dust and other contaminants may also adhere-to the roller. A build up of toner particles and/or paper dust on the heated roller leads to reduced image quality. In order to minimise the build up of toner, the heated rollers in photocopier machine fuser sections are usually coated with polytetrafluoroethylene (PTFE) which provides a non-stick surface to which toner particles are less likely to adhere. In addition there is also usually provided a cleaning element placed adjacent to the heated roller which is arranged to remove toner particles from the surface of the heated roller.

The cleaning element typically comprises a roller, the surface of which is arranged to accumulate the excess toner particles.

In one existing system where a cleaning roller is employed, the roller comprises a perforated aluminium cylinder, the surface of which is coated with a fabric, the exposed side of which has fibres projecting therefrom. These fibres comprise polyphenylene sulphide (PPS) fibres of 15 denier and are of approximately circular cross-section. In addition, the core of the cleaning cylinder forms a reservoir containing a silicone oil, which can pass through the perforations in the aluminium cylinder and is distributed through the fabric coating.

Such a cleaning roller is designed to remove and retain excess toner particles from the rollers, and particularly the heated roller, of the fuser section. The use of a silicone oil assists the removal of toner from the roller and also aids the retention of toner by the fabric coating of the cleaning roller.

A problem arises with known cleaning elements in so far as when a cleaning roller has become saturated with toner particles it becomes ineffective and therefore requires replacement. This is inconvenient and costly as the entire element is usually replaced.

Another problem with existing cleaning elements is that, where polyphenylene sulphide (PPS) fibres are used there is a tendency for these fibres to burn when in contact with the heated roller or other heated parts of electrostatographic reproduction equipment. When the fibres burn this reduces the cleaning performance of the roller. Also, these 15 denier fibres are sufficiently rigid to scratch the surface of the heated roller, this is undesirable as this exacerbates the problem of toner or other particles adhering to the roller. If the fibres become burned this may cause them to become more rigid making the problem worse. Wear of the heated roller can exacerbate the problem of excess toner adhering to the roller.

It is an object of the present invention to overcome or at least minimise the above mentioned problems associated with known cleaning elements and thereby to increase the effective cleaning effect of these elements, particularly the cleaning of photocopier fuser section rollers, along with a significant increase in useful working life of the element.

BRIEF SUMMARY OF THE INVENTION

According to the present invention, there is provided a cleaning element having projecting from an outer surface thereof forming a pile, the cross-section of each projection having a peripheral dimersion and an area, wherein the ratio of said peripheral dimension and cross-sectional area is greater than said ration for projection of circular or substantially circular and equal area of cross-section.

Perferably the pile comprises a cut pile of depth in range 1–20 mm, although a looped or partially looped pile may be used. Preferably each said projection is of multi-lobal cross-section. Preferably the projections forming the surface of the cleaning roller comprises a synthetic fiber which is preferably resistant to thermal breakdown at temperatures up to 250° C. or more preferably 260° C., suitable fibres comprising polyimide or PTFE. PPS could also be used. Also a mixture of suitable fibres could be used, intermixed or provided in zone across the surface of the element. The fibres preferably have a denier in the range 0.5–20 denier, more preferably by 0.5–15 denier, more preferably 0.5–5 denier, still more preferably 1–5 denier and particularly 5 denier.

It will be understood that there are many possible embodiments of the cleaning element in which the element takes different forms to enable its installation in different types of equipment and for different applications. Example of possible embodiments including cleaning rollers, cleaning pads and cleaning belts.

In one embodiment the element comprises a roller. The roller preferably comprises an aluminium cylinder or rod, to the surface of which is bonded a fabric, a surface of the fabric forming the outer surface of the roller and including the projections. The roller may incorporate a reservoir for storing and dispensing silicone oil into the fabric that forms the surface of the roller, the oil being utilised to enhance the preformance of the cleaning roller.

In another embodiment the element comprises a pad. The pad preferably comprises a felt pad, an example of a suitable material being that sold under the Nomex trade mark by Dupont, to the surface of which is bonded a fabric, a surface of the fabric forming the outer surface of the pad and including the projections. The pad may act as, or incorporate, a reservoir for storing and dispensing silicone oil onto the fabric that forms the surface of the pad, to enhance the cleaning performance of the pad. Alternatively the pad may comprise a silicone foam pad.

Other embodiments are possible, where the cleaning element is formed by any part of a machine or other to which there is affixed a fabric, a surface of the fabric forming the outer surface of the element and including the projections.

A cleaning element of the present invention exhibits a far greater surface area on which to accommodate excess toner particles than prior art elements of similar size. This greater area is achieved in that the shaft of each individual projection forming the pile on the surface of the element presents a larger surface area than projections of circular cross-section as used on existing elements. The provision of a larger surface area to accommodate toner particles, without increasing the size of the roller itself, enables rollers of the present invention to have an extended useful life over existing, similarly sized elements.

The use of projections having a cross-section as described tends to increase the rigidity of those projections over projections with a substantially circular and equal area of cross-section. This enables projections of a lower cross-sectional area, or lower denier in the case of fibres, to be employed without loss of the rigidity required for efficient removal of toner particles. By reducing the thickness of the individual projections or denier of the fibres that form those projections this allows for a greater density of projections to be accommodated on the surface of the element. Typically, the use of 2 denier fibres in comparison to the 15 denier fibres employed on existing elements enables the density of the fibres per unit surface are to be increased by a factor of at least 4. The use of a greater density of projections each having a greater surface area per length per unit cross-section leads to a still further increase in the available surface area for the accumulation of excess toner particles. This increases the useful life of the cleaning roller, typically to between 1.5 and 2.5 times that of existing roller, and also leads to more efficient cleaning of the heated roller In an experiment the preformance of cleaning roller, according to the present invention was compared with a conventional roller in use in photocopier. It was found that where the conventional roller as employed the quality of copies available form the machine deteriorated after 200,000 copies had been made, whereas with the roller according to the present invention the quality of copy did not deteriorate until in excess of 300,000 copies had been made.

The use of a lower projection size, or in the case of fibres a lower denier, and of a projection of greater resistance to thermal breakdown results in less abrasion of the heated roller or similar, prolonging fuser section life. A further advantage associated with the use of a lower projection size is that a greater pile depth than with existing elements can be employed able to accommodate still further toner particles without risk of damage to the heated roller.

The use of an element having both a greater cleaning surface area and finer projections also reduces the requirement for silicone oil due to increased mechanical action of the element leading to still further cost savings. Silicone oil is conventionally used to increase adherence of toner particles to the cleaning element and to reduce any damage caused by the element as a result of abrasion. As cleaning elements according to the present invention use fibres of lower denier than employed in prior art cleaning rollers it is possible for the element to be installed with a greater degree of interference fit. This increases the mechanical action of the element. Also the greater degree of interference means that the surface area on the sides of the projections is employed in cleaning and may also accumulate toner and other particles. Increasing the degree of interference fit with existing cleaning rollers tends to increase scratching of the heating roller by the cleaning roller. The degree of interference fit may be increased by incresing the diameter of the cleaning roller compared to an equivalent prior art roller.

Using less silicone oil is advantageous where duplex printing is concerned where it is desirable that only a minimum of silicone oil is transferred onto the paper during its first pass through the fuser section. Excess silicone oil can cause difficulties in getting toner to adhere to the paper.

Cleaning elements according to the present invention also have a better ability to wick silicone oil, due in part to their increased surface area. This leads to more efficient and even distribution of silicone oil.

BRIEF DESCRIPTION OF THE DRAWINGS

In order that the invention may be more clearly understood there is now described embodiments thereof, with reference to the accompanying drawings in which.

DETAILED DESCRIPTION OF THE INVENTION

Cleaning elements and their methods of use in electrostographic reproduction apparatus and printing apparatus according to the preferred embodiments of the present invention will now be explained.

Figure 1:
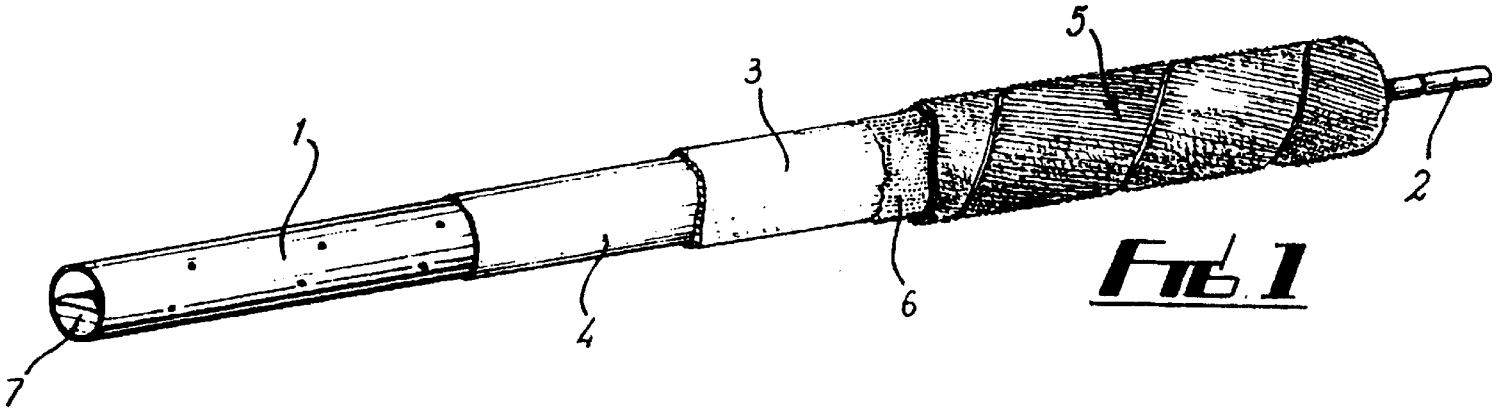
FIG. 1 shows a cut away perspective view of an incomplete cleaning roller of the present invention.

Referring to FIG. 1, there is illustrated, for reasons of clarity, an incomplete cleaning roller comprising a perforated aluminium cylinder 1 having a spindle 2 attached to the end thereof. It will be appreciated that a complete roller is fitted with a respective spindle 2 at each end thereof. Wrapped around the aluminium cylinder 1 there is a layer of non-woven textile 3 of predetermined permeability. The non-woven textile 3 is secured to the cylinder 1 by a length of adhesive tape 4. Bonded to the surface of the non-woven textile 3 is a fabric layer 5, which comprises a length of fabric, which is spirally wound around the cylinder, and affixed by means of adhesive 6, applied to the surface of the non-woven textile layer 3. Disposed in the centre of the aluminum cylinder is a quantity of silicone oil 7.

In use the roller is mounted adjacent to the heated roller of the fuser section of a photocopier, the fabric surface making contact with the heated roller. The silicone oil 7 passes through the perforations in the aluminium cylinder 1 and diffuses through the non-woven textile layer 3 at a predetermined rate to the fabric 6, from which it is transferred to the heated roller.

Figure 2:
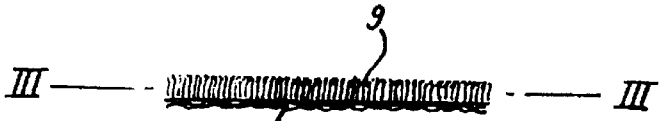
FIG. 2 shows a cross-section through the fabric that is bonded to the surface of the roller illustrated in FIG. 1.

Referring to FIG. 2 the fabric illustrated comprises a woven substrate 8 having a cut pile 9 projecting therefrom. The fibres forming the pile are polyimide fibres of 2 denier, the pile depth is approximately 3 mm.

Alternatively the pile could comprise a mixture of fibres. In one embodiment the fabric may be so arranged that the roller has alternating bands of different fibres along its length, for example alternating regions of 2 denier polyimide fibres and 16 denier PTFE fibres. The arrangement is particularly advantageous where a cleaning roller is used in conjunction with a beater or scraper bar. The polyimide fibres will act to clean the fuser section and the beater or scraper bar will push excess toner particles onto the PTFE section of the brush and, optionally, into a hopper.

Figure 3:
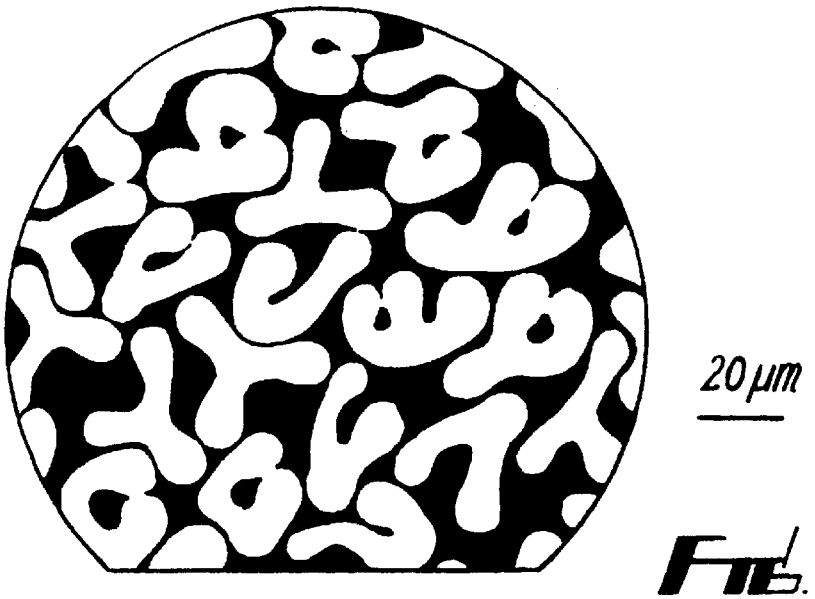
FIG. 3 shows a cross-section along the line III—III through the pile of the fabric illustrated in FIG. 2.

Referring to FIG. 3 there is shown the cross-section of the polyimide fibres forming the pile of the fabric illustrated in FIG. 2. The fibres are of tri-lobal cross-section, the ratio of the distance around the perimeter of the cross-section of these fibres to their cross-sectional area is greater than that for fibres of substantially circular cross-section having the same cross-sectional area.

Figure 4:
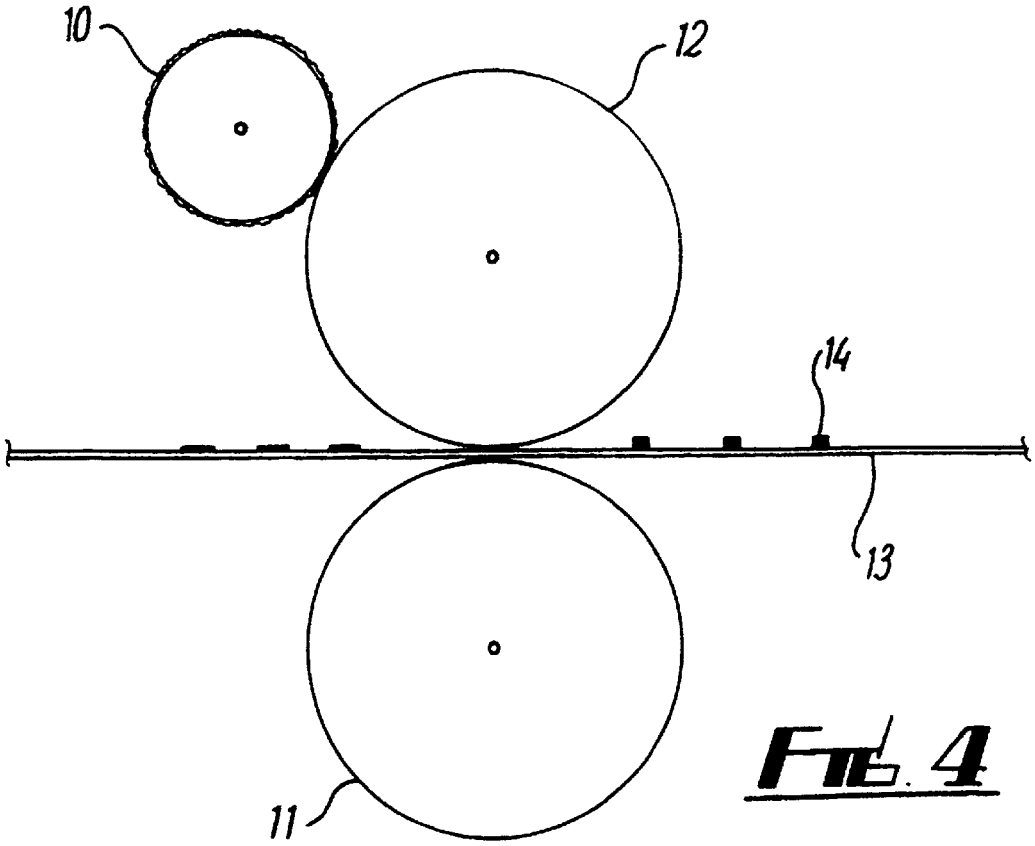
FIG. 4 shows an end view of a cleaning roller as mounted in a photocopier machine.

Referring to FIG. 4, there is illustrated a cleaning roller 10, shown in relation to the fuser section of a photocopier.

The fuser section comprises two rollers 11 and 12, roller 12 is heated to approximately 180° C., the surface of the roller 12 is coated with PTFE. Paper 13, onto one side of which toner 14 has been deposited is fed between rollers 11 and 12.

The cleaning roller 10 is disposed to rotate adjacent to the heated roller 12, in order to remove any toner particles which adhere to this roller.

Figure 5:
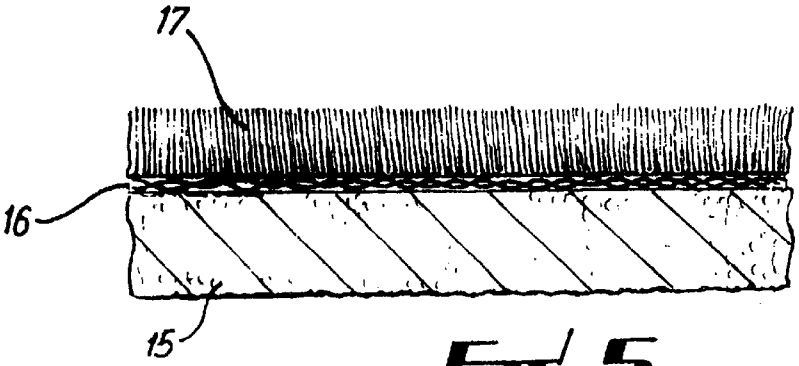
FIG. 5 shows a cross-section through a part of a cleaning pad according to the present invention.

Referring to FIG. 5 there is illustrated a cross-section through a part of a cleaning pad which comprises a felt pad 15, approximately 4 mm thick, to which there is bonded a fabric layer which comprises a woven substrate 16, having a cut pile 17, projecting therefrom. The fibres forming the pile are polyimide fibres of 2 denier and are of tri-lobal cross-section, the pile depth is approximately 3 mm.

The fabric layer is the same as the fabric illustrated by FIGS. 2 and 3.

The above described embodiments afford advantages over the prior art. By the provision of 2 denier fibres of tri-lobal cross-section there is a substantially increased surface area on which excess toner particles can collect when compared to known cleaning rollers or pads of similar dimensions. The use of fibres with a tri-lobal cross-section allows a lower denier of fibre to be used than would be required to maintain sufficient rigidity for effective cleaning with fibres of circular cross-section. The use of a fibre of lower denier enables more fibres to be accommodated per unit area on the surface of the roller or pad, increasing the available surface area for the accumulation of toner particles. The 2 denier polyimide fibres form a softer and more heat resistant pile than that of known rollers or pads, less likely to damage photocopier fuser section rollers or similar and reducing the requirement for silicone oil, the diffusion of which is controlled by the intermediate non-woven layer or, in the case of the pad is stored in the felt pad. The result is an enhanced useful life over existing rollers or pads of similar dimension, typically between 1.5 and 2.5 times that of existing rollers, as well as improved cleaning efficiency.

The above embodiment is described by way of example only, many variations are possible without departing from the invention. For example the cleaning elements could be employed in apparatus other than photocopiers, for example laser printers. Also elements according to the present invention could be used without silicone oil.

What is claimed is:

1. A cleaning element for cleaning photocopiers, electrostatic reproduction apparatus, laser printers, and printing apparatus, comprising:

a pile of fibres having a cross-section with a peripheral dimension and an area, the ratio of said peripheral dimension of each of said fibres to the cross-sectional area of each of said fibres being greater than the ratio for a fibre of substantially circular cross-section with an equal cross-sectional area;

said cleaning element having a surface area with a toner-collecting portion for collecting and accumulating toner particles; and wherein the cleaning element comprises a roller, the roller comprising a metal cylinder or rod to the surface of which is bonded a layer of permeable material to which in turn is bonded a fabric, the fabric forming the outer surface of the roller and including the fibres.

2. A cleaning element according to claim 1, wherein the fibres are of multi-lobal cross section.

3. A cleaning element according to claim 1, wherein the fibres form a cut pile with a depth in the range 1–15 mm.

4. A cleaning element according to claim 1, wherein the fibres are selected from the group consisting of: polyimide, PTFE or PPS.

5. A cleaning element according to claim 1, wherein the fibres comprise a synthetic fibre resistant to thermal breakdown at temperatures up to 250° C.

6. A cleaning element according to claim 1, wherein the fibres have a denier in the range 0.5–20 denier.

7. A cleaning element according to claim 6, wherein said fibres have a denier in the range 1–5 denier.

8. A cleaning element according to claim 1, wherein said fibres are of a tri-lobal cross-section.

9. A cleaning element according to claim 1, wherein each fibre has a shaft with a larger surface area than a fibre of circular cross section with an equal cross-sectional area.

10. A cleaning element according to claim 1, wherein said substantially circular cross-section consists of a circular cross-section.

11. A roll cleaning device comprising:

a) a cleaning element positioned adjacent the roll so as to clean it as it rotates with respect thereto, the cleaning element including a pile surface on an exterior thereof;

b) the pile surface comprising a plurality of fibers of multi-lobal cross-section and having a denier in the range of 0.5 to 20, the pile depth is in the range of 1 to 15 mm, and the fibers are of a synthetic material resistant to thermal breakdown at temperatures up to 250 degrees C., the synthetic material selected from the group consisting of polyimide, polytetrafluorethylene and polyphenylene sulphide; and c) wherein the fiber cross-section is particularly adapted to remove particles on the surface of the roll being cleaned and the material of the fibers will not break down when the cleaning element is used to clean a heated roll.

12. A cleaning element according to claim 11, wherein the cleaning element comprises a roller.

13. A cleaning element according to claim 11, wherein the cleaning element comprises a pad.

14. A cleaning element according to claim 13, wherein the pad comprises a felt pad.

15. A cleaning element according to claim 13, wherein the pad comprises a silicone foam pad.

16. A cleaning element according to claim 11, wherein the cleaning element comprises a reservoir for silicone oil.

* * * * *